US009004052B1

(12) United States Patent
Poirier

(10) Patent No.: US 9,004,052 B1
(45) Date of Patent: Apr. 14, 2015

(54) LAUNCH APPARATUS FOR TOY DISCS WITH DISC FLIP MECHANISM

(71) Applicant: Hasbro, Inc., Pawtucket, RI (US)

(72) Inventor: Mark Alan Poirier, Hubbardston, MA (US)

(73) Assignee: Hasbro, Inc., Pawtucket, RI (US)

( * ) Notice: Subject to any disclaimer, the term of this patent is extended or adjusted under 35 U.S.C. 154(b) by 332 days.

(21) Appl. No.: 13/681,612

(22) Filed: Nov. 20, 2012

(51) Int. Cl.
*F41B 7/08* (2006.01)
*F41B 7/00* (2006.01)

(52) U.S. Cl.
CPC .. *F41B 7/006* (2013.01); *F41B 7/08* (2013.01)

(58) Field of Classification Search
CPC ..... F41B 7/006; F41B 7/08
USPC ..... 124/27, 42, 46, 47, 48, 82
See application file for complete search history.

(56) References Cited

U.S. PATENT DOCUMENTS

| | | | | | |
|---|---|---|---|---|---|
| 961,511 | A * | 6/1910 | Marble | 42/72 |
| 1,374,757 | A * | 4/1921 | Napier | 124/26 |
| 1,441,975 | A * | 1/1923 | Edelin | 124/67 |
| 2,109,589 | A * | 3/1938 | Horwitt et al. | 222/79 |
| 2,646,786 | A * | 7/1953 | Robertson | 124/26 |
| 2,827,036 | A * | 3/1958 | Ervine et al. | 124/47 |
| 2,996,058 | A * | 8/1961 | Ervine | 124/8 |
| 3,088,452 | A * | 5/1963 | Foster | 124/43 |
| 3,515,114 | A * | 6/1970 | Carbonneau | 124/27 |
| 3,559,630 | A * | 2/1971 | Frye | 124/2 |
| 3,621,828 | A * | 11/1971 | Hansen | 124/8 |
| 3,717,136 | A * | 2/1973 | Gat et al. | 124/21 |
| 3,876,201 | A * | 4/1975 | King | 473/446 |
| 3,968,783 | A * | 7/1976 | Pfotenhauer | 124/25 |
| 4,016,854 | A * | 4/1977 | Lehman | 124/27 |
| 4,170,215 | A * | 10/1979 | Kettlestrings | 124/16 |
| 4,248,202 | A * | 2/1981 | Jaworski et al. | 124/16 |
| 4,524,672 | A * | 6/1985 | Balsavage | 89/33.1 |
| 4,659,320 | A * | 4/1987 | Rich et al. | 446/435 |
| 5,050,575 | A * | 9/1991 | Killion | 124/8 |
| 5,239,911 | A * | 8/1993 | Ostor | 89/33.1 |
| 5,267,549 | A * | 12/1993 | Webber | 124/65 |
| 5,292,134 | A * | 3/1994 | Schlundt et al. | 473/511 |
| 5,377,656 | A * | 1/1995 | Lewinski et al. | 124/65 |
| 5,433,646 | A * | 7/1995 | Tarng | 446/473 |
| 5,471,967 | A * | 12/1995 | Matsuzaki et al. | 124/6 |
| 5,529,050 | A * | 6/1996 | D'Andrade | 124/56 |
| 5,605,140 | A * | 2/1997 | Griffin | 124/59 |
| 5,611,322 | A | 3/1997 | Matsuzaki et al. | |
| 5,613,482 | A * | 3/1997 | Thai et al. | 124/16 |
| 5,711,285 | A * | 1/1998 | Stewart et al. | 124/67 |
| 5,996,564 | A * | 12/1999 | Kotowski | 124/6 |
| 6,176,229 | B1 * | 1/2001 | Patenaude | 124/8 |
| 6,224,457 | B1 * | 5/2001 | Wu | 446/473 |

(Continued)

*Primary Examiner* — Melba Bumgarner
*Assistant Examiner* — Alexander Niconovich
(74) *Attorney, Agent, or Firm* — Perry Hoffman

(57) ABSTRACT

A toy pump action rifle for launching discs having an outer housing, a stock, a grip, a trigger, a handle for cocking the rifle and a revolving drum for storing multiple discs. Within the housing is a mechanism for removing discs, one at a time, from the drum where the discs are arranged in a first position, rotating each disc 90° to a second position, and transporting each disc to a discharge chamber. The mechanism includes a transfer arm to remove each disc from the drum, a disc pocket for receiving the removed disc, the pocket being rotatable to reorient the disc, and disc pocket also being slidable to carry the disc to the discharge chamber. Activation of the trigger releases a cocked launch arm that snaps forward and strikes the disc to cause discharge.

20 Claims, 6 Drawing Sheets

FIG. 7

(56) References Cited

U.S. PATENT DOCUMENTS

| | | | | |
|---|---|---|---|---|
| 6,598,329 | B1 * | 7/2003 | Alexander | 42/71.01 |
| 6,733,356 | B2 * | 5/2004 | Lee | 446/63 |
| 6,884,186 | B2 | 4/2005 | Fluckiger et al. | |
| 7,287,526 | B1 * | 10/2007 | Bligh et al. | 124/63 |
| 7,418,797 | B1 * | 9/2008 | Crose | 42/74 |
| 7,437,847 | B1 * | 10/2008 | Mabry | 42/71.02 |
| 7,552,557 | B1 * | 6/2009 | Mabry | 42/72 |
| 7,673,624 | B2 * | 3/2010 | Rosella, Jr. | 124/10 |
| 8,402,956 | B2 * | 3/2013 | Dakan et al. | 124/27 |
| 8,485,170 | B1 * | 7/2013 | Prior | 124/27 |
| 8,567,377 | B2 * | 10/2013 | Victor | 124/27 |
| 8,820,305 | B2 * | 9/2014 | Victor et al. | 124/27 |
| 2004/0082411 | A1 * | 4/2004 | Fluckiger et al. | 473/446 |
| 2006/0242880 | A1 * | 11/2006 | Griffin | 42/73 |

* cited by examiner

LAUNCH APPARATUS FOR TOY DISCS WITH DISC FLIP MECHANISM

FIELD OF THE INVENTION

The present invention relates generally to a launch apparatus for toy discs, and, more particularly, to a launch apparatus for toy discs where the discs are stored in one position and a discharge location requires that each disc be rotated 90°.

BACKGROUND OF THE INVENTION

Toys and other devices that discharge disc-like objects have been designed in the past. For example, in 1953, U.S. Pat. No. 2,646,786 issued to Robertson for a "Cylindrical Object Ejecting Apparatus," and purports to disclose a revolving drum for launching military Sono buoys from a slot opening in a flying aircraft. The cylindrical buoys are disposed on the drum with longitudinal axes generally parallel to the longitudinal axis of the aircraft, and a pivotal arm pushes each buoy through the slot. In 1958, U.S. Pat. No. 2,827,036 for a "Magazine Target Trap" issued to Ervine et al., and purports to disclose a target-throwing device where the targets are disposed horizontally in vertical stacks and a throwing arm automatically launches the targets horizontally one at a time. Three years later, U.S. Pat. No. 2,996,058 issued to Ervine under the same title as his 1958 patent and discloses another target throwing device where the targets are disposed horizontally in vertical stacks and a throwing arm automatically launches the targets horizontally. U.S. Pat. No. 3,088,452, issued in 1963 for a "Target Throwing Apparatus" to Foster and purports to operate in the same manner as describe for the two preceding patents. U.S. Pat. No. 3,621,828, issued to Hansen in 1971 for a "Target Projecting Device With Magazine Indexing Mechanism" also purports to generally operate in the same manner as the three preceding patents. In 1975, U.S. Pat. No. 3,876,201, issued for an "Apparatus For Projecting Hockey Pucks" to King and purports to generally describe a device as described above, except substituting hockey pucks for targets.

Devices of for pivoting an object before discharge have also been designed. U.S. Pat. No. 4,524,672, issued to Balsavage in 1985 for a "Magazine And Feed Mechanism For Firearms," purports to load a cartridge from a magazine where the cartridges are arranged laterally to a barrel. An injector element rotates downward to push a cartridge passed flexible arms biased by torsion springs. The injector element has an inwardly curved surface for pushing a cartridge and another surface having an outwardly curved surface for blocking a succeeding cartridge. The cartridge is delivered to a rotatable transfer platform to realign the cartridge from a perpendicular position relative to the barrel to a parallel position aligned with the barrel. In 1993, U.S. Pat. No. 5,239,911, issued to Ostor for a "Multiple-Round Grenade Launcher," and purports to also use a pivoting platform to rotate a grenade stored perpendicular to a barrel to a position aligned with the barrel. Eleven years later, U.S. Patent Application Publication, No. 2004/0082411 A1 discloses a "Game Projectile Dispensing Device" listing Fluckiger and others as inventors, the publication disclosing a hockey puck dispensing apparatus having an upright cylindrical puck-retaining device that has a semicircular retaining wall with an aperture. The pucks are stored horizontally, and an actuating lever positioned through the aperture pushes the lower-most puck off of the retaining wall when the lever is pivoted. The puck falls into a space with an angled wall causing the puck to tilt from a horizontal position to a vertical position before exiting the device and rolling away.

These patents and devices are of some interest, however, they do not disclose or illustrate a robust apparatus for taking a disc from an alignment in a drum perpendicular to a longitudinal axis of the apparatus to an alignment in a discharge chamber parallel to the longitudinal axis of the apparatus where the disc is located to be struck by a launch arm.

SUMMARY OF THE INVENTION

In accordance with the present invention, an advantageous method and apparatus are provided in the form of a launch apparatus for toy discs that discharges a soft foam circular projectile. The launch apparatus is easily operated, even by young children, and requires a handle to slide rearward and then forward to cock a launch arm, remove a disc from a storage drum and transfer the disc to a discharge chamber. In the process the disc is flipped from a position perpendicular to a longitudinal axis of the apparatus to a position parallel to the longitudinal axis of the apparatus. The launch apparatus has the advantages of being relatively simple, easy to operate, fun to use, safe, relatively inexpensive, and yet, structurally robust.

Briefly summarized, the invention relates to a launch apparatus for toy discs including a housing having a longitudinal axis, a container mounted to the housing for storing toy discs, the discs being stored with rotational axes disposed parallel to the longitudinal axis of the housing, a handle mounted to the housing movable between first and second positions, a disc pocket mounted in the housing and operatively connected to the handle for moving the disc pocket between forward and rearward positions, the disc pocket also being rotatable between a disc receiving position and a disc delivery position, the disc pocket rotating to the disc receiving position when the handle moves from the first position to the second position and the disc pocket rotating to the disc delivery position when the handle moves from the second position to the first position, a spring biased transfer arm pivotally mounted in the housing and operatively connected to the handle for sliding a disc from the disc container into the disc pocket when the disc pocket is in the disc receiving position, a spring biased launch arm pivotally mounted in the housing and operatively connected to the handle, the launch arm being cocked when the handle is moved from the first position to the second position, and a trigger mounted to the housing and operatively connected to the launch arm for activating the launch arm after the disc pocket delivers a disc to a discharge chamber in the housing.

The invention also relates to a method for making a launch apparatus for toy discs, the steps of the method including providing a housing, mounting a container of discs to the housing, attaching a slidable handle to the housing, the handle being movable between first and second positions, connecting a disc pocket in the housing for movement by the handle, the disc pocket being movable between forward and rearward positions and rotatable through 90° for receiving a disc and delivering the disc to a discharge chamber in the housing, mounting a pivotal transfer arm in the housing for movement by the handle, the transfer arm for removing a disc from the container and inserting the removed disc into the disc pocket, mounting a pivotal launch arm in the housing for impacting the disc in the discharge chamber, and connecting a trigger to the housing for activating the launch arm.

BRIEF DESCRIPTION OF THE DRAWINGS

For the purpose of facilitating an understanding of the invention, the accompanying drawings and detailed description illustrate a preferred embodiment thereof, from which the invention, its structures, its construction and operation, its processes, and many related advantages may be readily understood and appreciated.

DESCRIPTION OF THE PREFERRED EMBODIMENT

Figure 1:
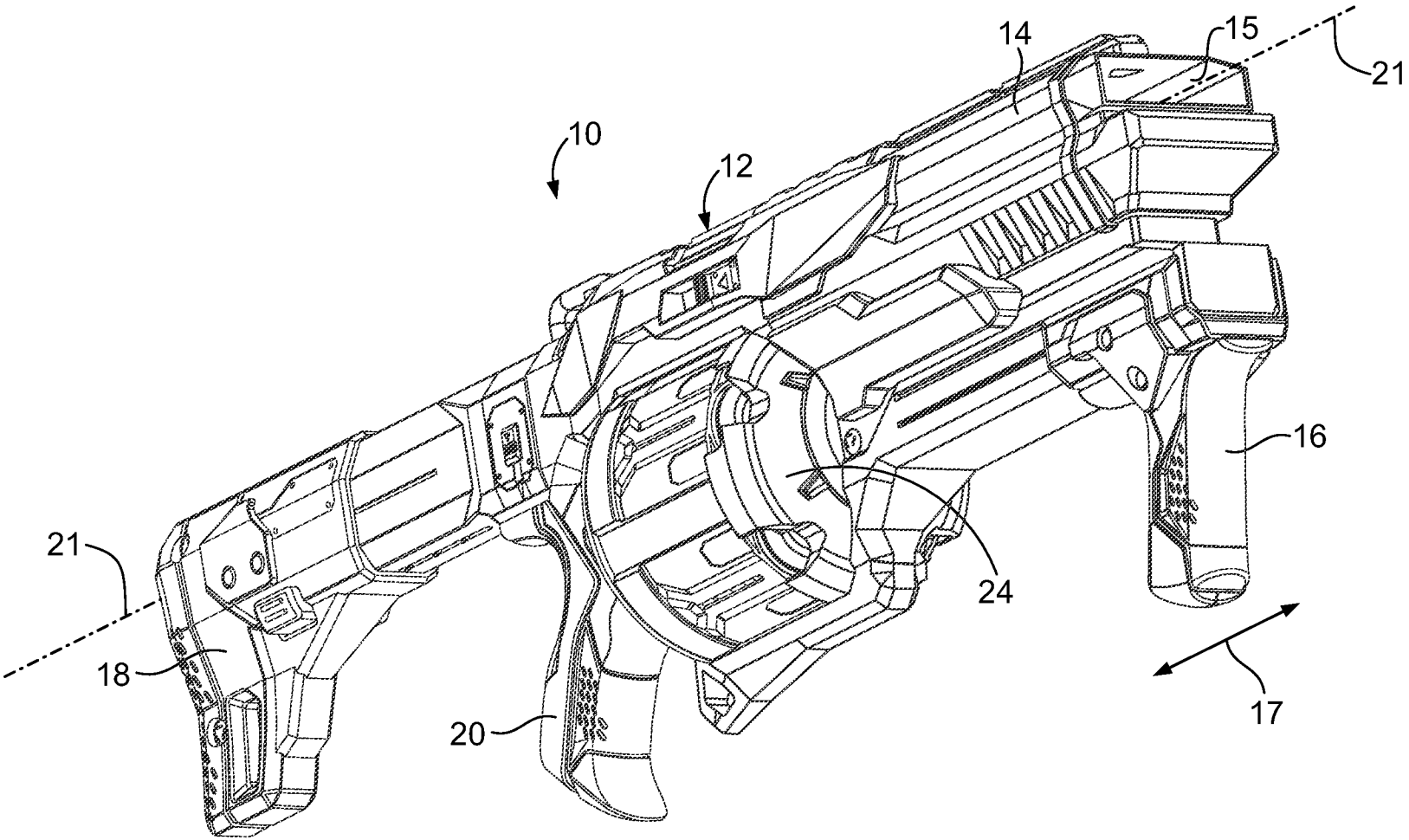
FIG. 1 is an upward looking isometric view of a preferred embodiment of the launch apparatus for toy discs in the form of a stylized pump action rifle.

The following description is provided to enable those skilled in the art to make and use the described embodiment set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

The present invention is a launch apparatus for multiple toy discs. An embodiment of the present invention described in detail below and illustrated in the attached drawings includes a stylized pump action rifle 10, FIGS. 1 and 2. The rifle includes an outer housing 12 having a barrel portion 14 with a discharge chamber and a disc exit opening 15. A pump or cocking handle 16 is slidably mounted to the housing 12 and is movable between a first or forward position and a second or rearward position as symbolized by a double-headed arrow 17. The housing also includes a stock portion 18 and a grip 20 and has a longitudinal axis 21. Mounted in the grip 20 is a trigger 22 and mounted to the housing 12 is a revolving container, magazine or drum 24 for storing discs to be discharged. An operator slides the handle 16 rearward to cock a launch arm, and forward to position a disc for discharge.

In the alternative, the handle may move in reverse, between a first or rearward position and a second or forward position. The launch apparatus may take the form of a pump action rifle without the stock and/or without the revolving drum. The disc launch apparatus may be designed as a gun instead of a rifle and include an elongated disc container mounted to the gun.

Figure 3:
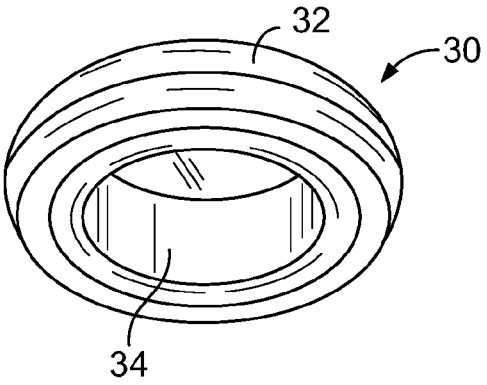
FIG. 3 is an upward looking isometric view of a toy disc to be used with the rifle shown in FIGS. 1 and 2.
Figure 4:
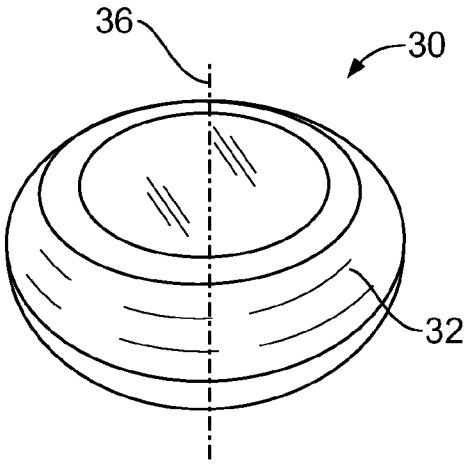
FIG. 4 is a downward looking isometric view of the toy disc shown in FIG. 3.

Referring now to FIGS. 3 and 4, there is shown a disc 30 of the type that may be used in conjunction with the pump action rifle 10. The disc 30 is specially constructed by including a soft exterior 32 covering a more robust interior 34, such as the disc shown and described in U.S. Patent Application No. 2012/0077409 A1, published Mar. 29, 2012, incorporated herein by reference. The disc also has a rotational axis 36. The disc projectile is structured to be discharged from the toy launch apparatus with discharge energy being imparted to the disc by a brief, but sharp, impact on a relatively small contact area of the disc interior 34 from a launch arm in the rifle. It is important to note that discs are positioned in a horizontal position prior to discharge, assuming that the rifle is held in the usual manner during play where the longitudinal axis of the rifle is generally positioned horizontally. The horizontal position is more generally described by defining the attitude of the discs as having the rotational axes 36 of the discs perpendicular to the longitudinal axis 21 of the rifle 10. The manner of discharge will be described in detail below.

As also described in detail below, the discs are positioned in the drum 24 in a vertical position relative to the horizontal longitudinal axis of the rifle, about 90° away from the discharge position of the discs. Described more broadly, the discs are positioned such that their rotational axes 36 are parallel to the longitudinal axis 21 of the rifle 10. Because of the different positions that the discs are placed in, the rifle must include a "flip" or reorientation mechanism for the discs from the position where the rotational axes of the discs are parallel to the longitudinal axis of the rifle to the position where the rotational axes of the discs are perpendicular to the longitudinal axis of the rifle. This reorientation is accomplished with a relatively simple structure that is robust and easily manipulated.

Figure 2:
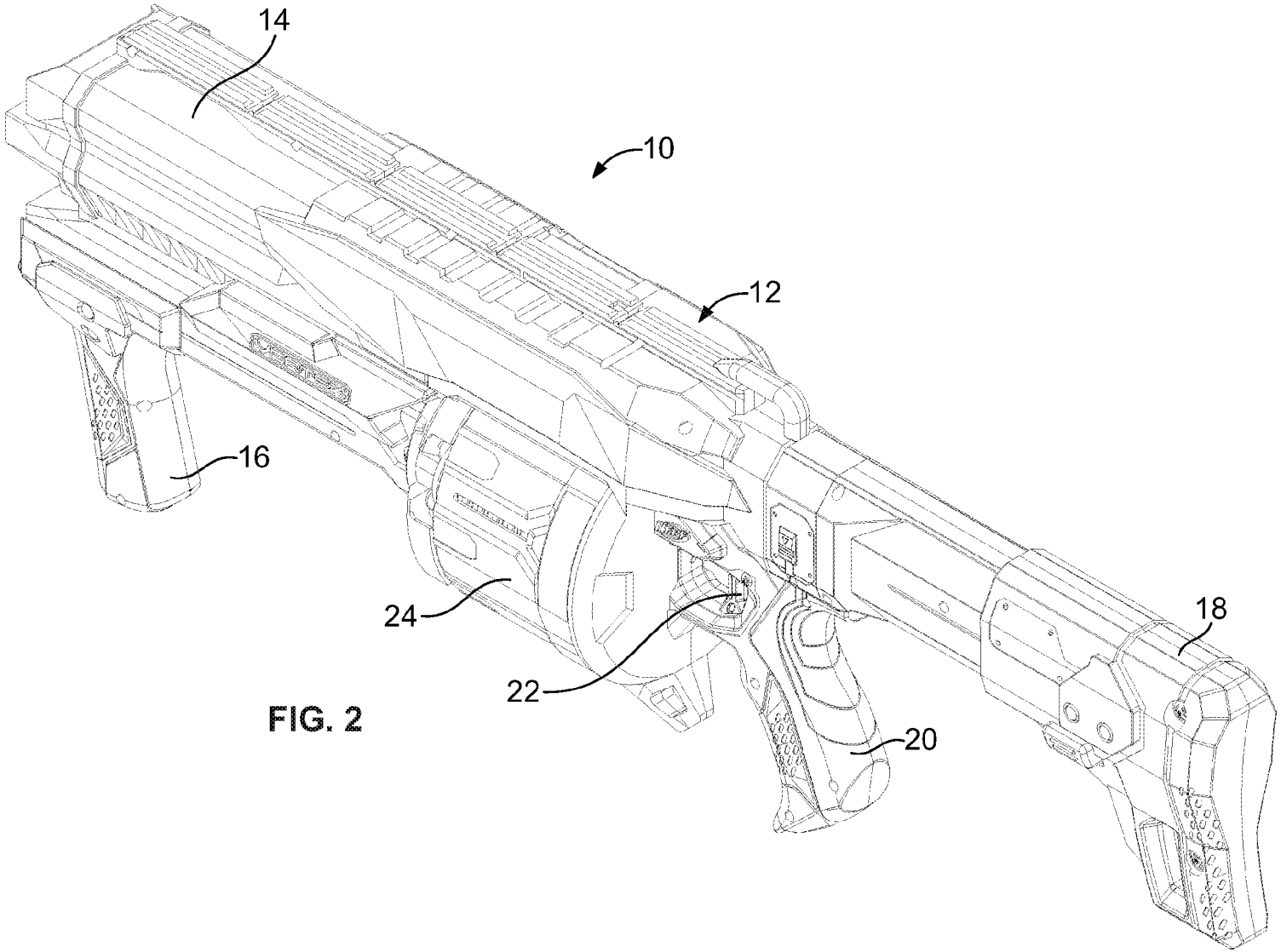
FIG. 2 is a downward looking isometric view of the launch apparatus shown in FIG. 1, after a rotation of 180°.
Figure 5:
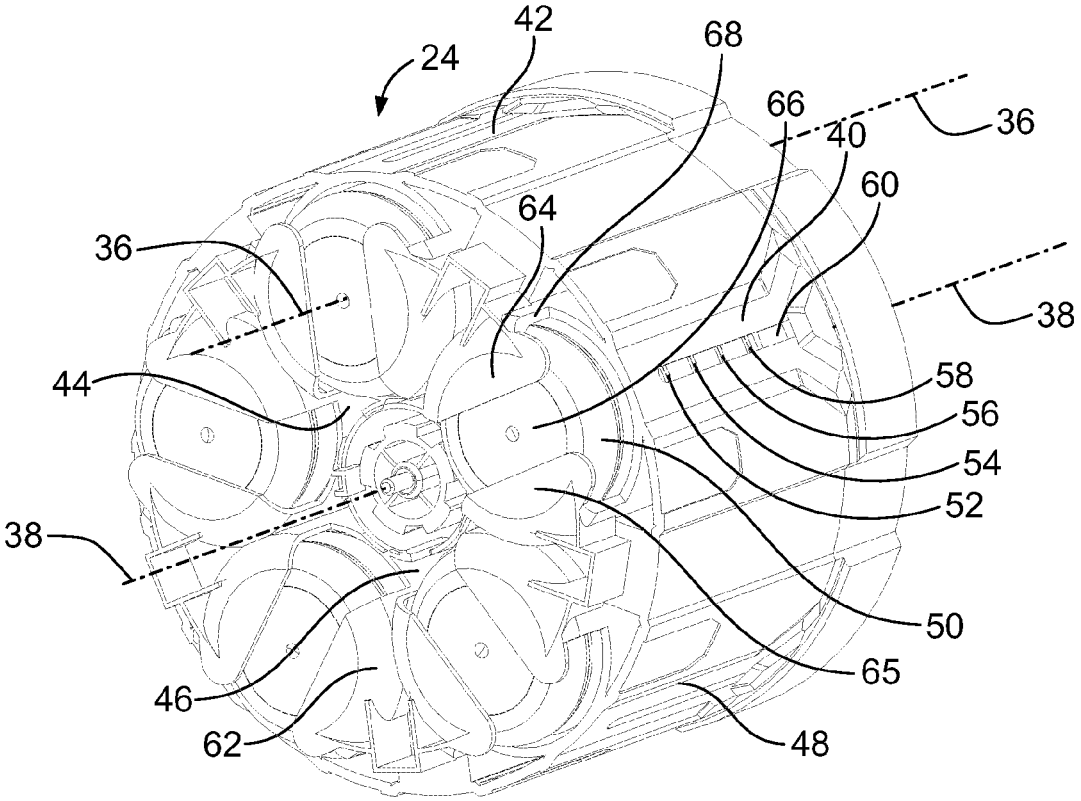
FIG. 5 is a front isometric view of a revolving disc-carrying drum used in the rifle shown in FIGS. 1 and 2.

The drum 24, FIGS. 1, 2, and 5, is a disc container having a generally cylindrical shape and is mounted to the housing 12 so as to revolve about an axis 38. The drum 24 includes five cylindrically shaped chambers 40, 42, 44, 46, 48, each chamber having a stack of five discs, such as the discs 50, 52, 54, 56, 58 of the chamber 40, and a spring biased piston 60 for pushing the discs forward (to the left in the view of FIG. 5). At the forward end 62 of each disc chamber are spaced apart arms and a central opening, such as the arms 64, 65 and the central opening 66 of the chamber 40, and an outer opening 68, so that the most forward of the discs, such as the disc 50 in the chamber 40, may be removed from the disc chamber in a direction radially outward during the process of repositioning a disc for discharge, the repositioning being from the "vertical" position to the "horizontal" position; that is, the repositioning of a disc is from having the disc aligned so that its rotational axis 36 is parallel to the longitudinal axis 21 of the rifle as well as the longitudinal axis 38 of the drum, to having the disc aligned so that its rotational axis is perpendicular to the longitudinal axes of the rifle and the drum.

Discs may be loaded into the chambers through any of the access openings in the rifle by aligning a chamber with an opening, as shown in FIG. 1, and manually inserting the discs. The disc chambers, in the alternative, may each contain more or less than five discs. Also in the alternative, discs may be of a smaller scale causing the size of the drum to be reduced in size and/or the drum may house more chambers. Another alternative may include the use of a single elongated cylinder holding about twenty discs, for example, instead of using the multi-chamber drum.

Figure 6:
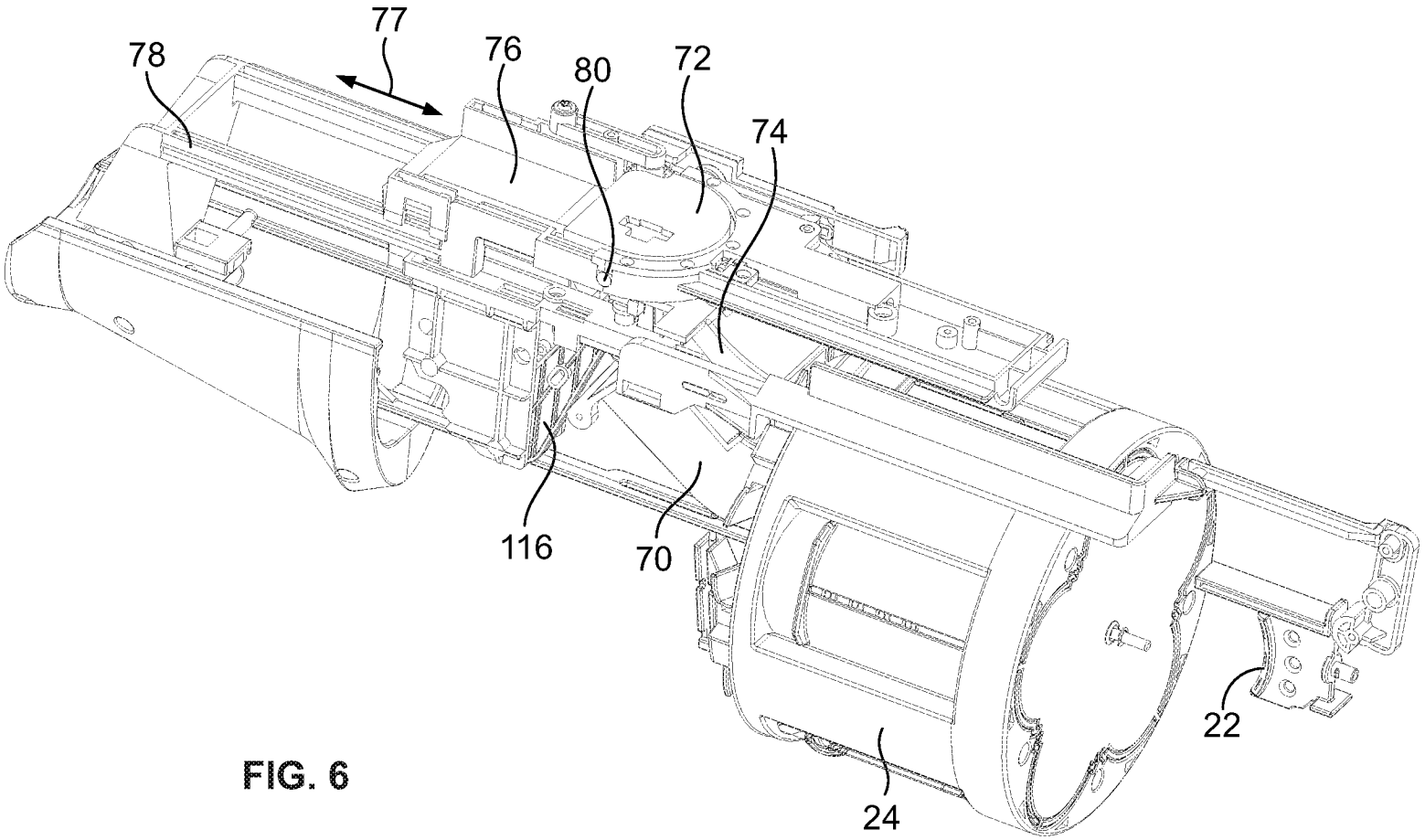
FIG. 6 is a downward looking isometric view similar to that shown in FIG. 2, after an outer housing has been removed.
Figure 7:
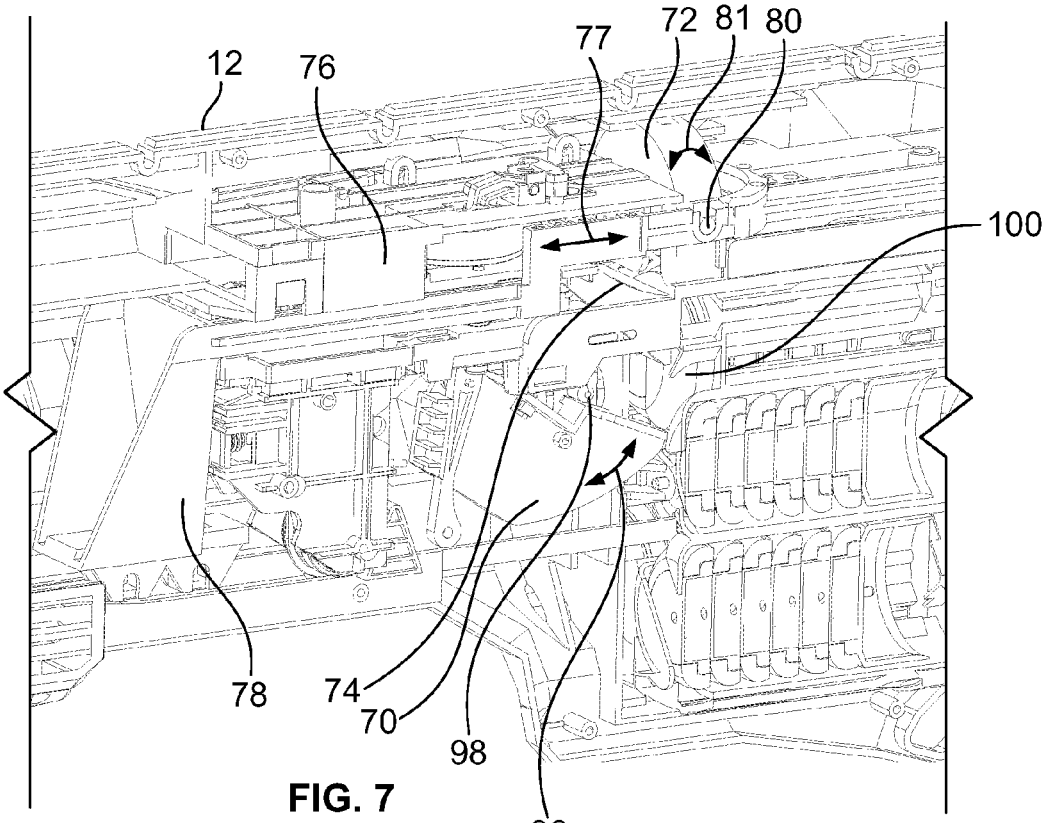
FIG. 7 is a side isometric view, in section, of a portion of the rifle shown in FIGS. 1 and 2, after the outer housing has been removed.
Figure 8:
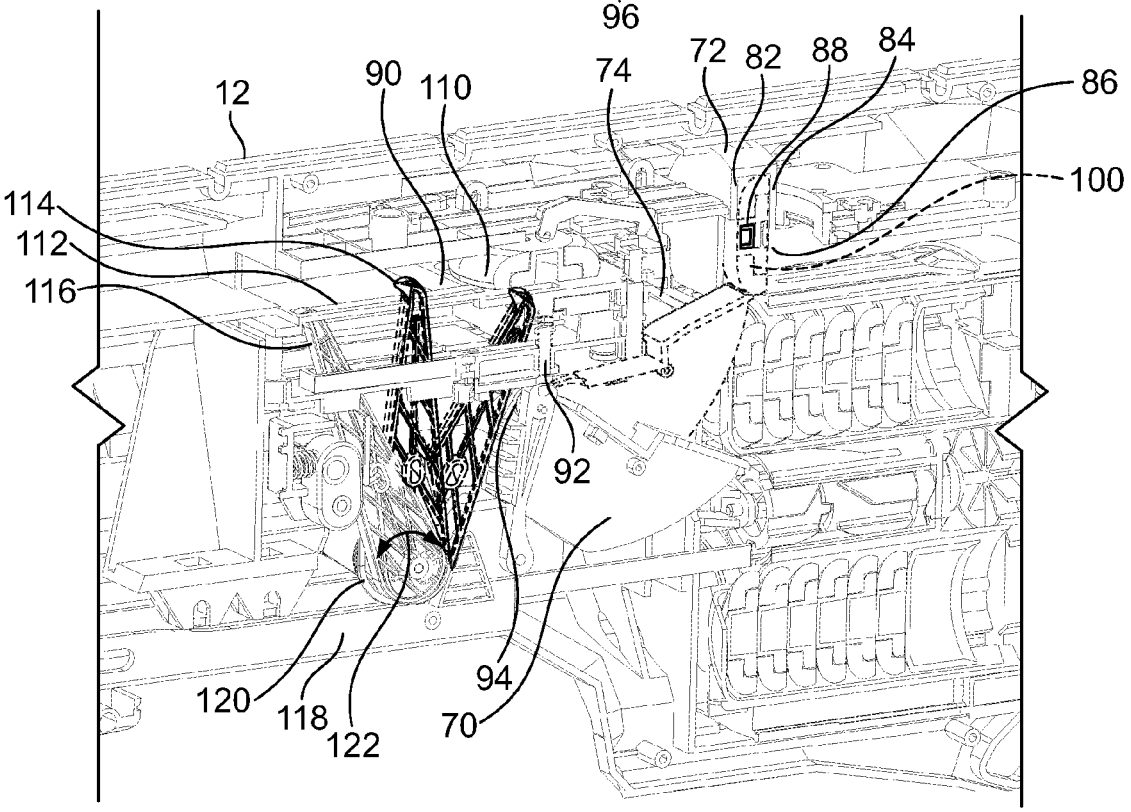
FIG. 8 is another side isometric view, also in section, similar to the view shown in FIG. 7.
Figure 9:
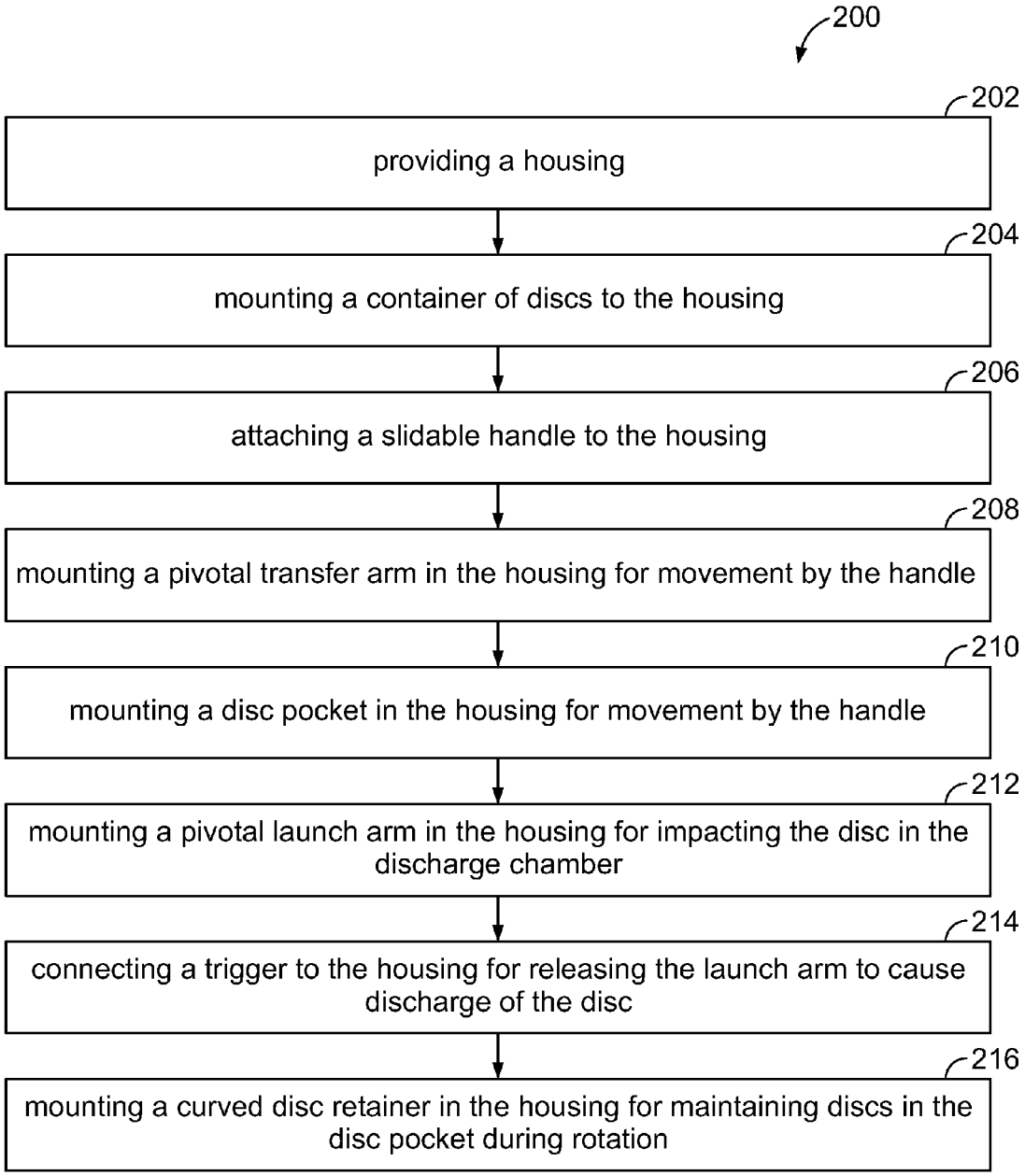
FIG. 9 is a flow diagram for a method of making the rifle illustrated in FIGS. 1 and 2.

The mechanism for moving a disc from the drum to a discharge chamber including rotating the disc through 90° is illustrated in FIGS. 6-8. The mechanism is mounted within the housing 12 and includes a disc ram or transfer arm 70, a rotatable disc cage or pocket 72 and a curved disc retainer 74. The disc pocket 72 is shown from above in the view of FIG. 6, a view like that of FIG. 2, where the housing 12 has been removed. The disc pocket is part of a slide assembly 76 that is moved by the handle 16 between forward and rearward positions, symbolized by a double-headed arrow 77. A framework 78 mounted in the housing 12 supports the slide assembly 76. When the handle 16, attached to the housing 12, is moved rearward, to the right in the view of FIG. 6, the disc pocket 72 also moves rearward. At about the end of the rearward stroke of the handle the disc pocket 72 also rotates about axles configured generally perpendicular to a longitudinal axis 21 of the rifle, such as the axle 80, FIGS. 6-7. An identical axle (not shown) is located on the opposite side of the disc pocket.

Rotation allows the disc pocket to move from a disc delivery position shown in FIG. 6, to a disc receiving position shown in FIGS. 7 and 8, symbolized by a double-headed curved arrow 81. In the disc receiving position the disc pocket is perpendicular to the longitudinal axis 21 of the rifle, and in the disc delivery position the disc pocket is parallel to the longitudinal axis of the rifle. The disc pocket 72 includes two walls 82, 84, FIG. 8, and an open bottom 86. Mounted to the wall 84 is a latch 88 to restrain a disc loaded in the disc pocket, illustrated in FIG. 8. After the disc pocket 72 receives the disc, and the operator moves the handle 16 in a forward direction, the loaded disc pocket 72 again rotates 90°, and moves the disc to the discharge chamber 90, FIG. 8.

The transfer arm 70 is pivotally mounted in the housing 12 and connected to an internal framework 92, FIG. 8. The transfer arm 70 moves between a lowered position illustrated in solid lines in FIGS. 7 and 8, and a raised position illustrated in phantom lines in FIG. 8, by a torsion spring 94, the rotation being symbolized by a double-headed arrow 96, FIG. 7. During movement of the transfer arm between the lowered position and the raised position, the transfer arm 70 slides a disc, such as the disc 100, from the drum 24 into the disc pocket 72 when the disc pocket is in the disc receiving position as shown in FIG. 8. Initially, the transfer arm 70 is restrained in the lowered position during movement of the handle rearward, by a pin 98, FIG. 7, which abuts the transfer arm and prevents the torsion spring 94 form rotating the transfer arm. The transfer arm cannot move upward when the handle 16 begins its rearward movement; however, when the handle reaches its rearward position, the pin 98 is pulled away from a blocking position and the transfer arm 70 moves from the lowered position to the raised position under the influence of the torsion spring 94, in a counterclockwise rotation, as viewed in FIG. 8.

The transfer arm 70 includes a narrow flat surface 99 that moves between the arms in the central opening of a drum chamber, such as the arms 64, 65, FIG. 5, and the central opening 66, to "scoop" the disc 100 out of the drum chamber and insert the disc into the disc pocket 72, the disc 100 in the disc pocket being shown in phantom lines, FIG. 8. During its rotation, the transfer arm 70 engages the periphery of the forward most disc 100 of a stack aligned in the chamber 42 of the drum 24. When the handle 16 is returned forward, the transfer arm 70 is rotated clockwise back to its lowered position and in the process the transfer arm torsion spring 94 is biased or cocked.

As the operator pushes the handle 16 forward, the disc pocket 72 returns to the disc delivery position shown in FIG. 6. During the return rotation of the disc pocket to the disc delivery position, the curved disc retainer 74, FIGS. 7 and 8, helps to prevent the disc in the disc pocket from sliding out and so facilitates retention of the disc in the disc pocket. The disc pocket 72 then positions the disc in the discharge chamber 90. The discharge chamber 90, as shown in FIG. 8, with a disc 110 in a discharge-ready position, includes a slotted floor 112 to accommodate an upper portion 114 of a launch arm 116 mounted in the housing 12 that is cocked by the movement of the handle 16 at the same time that the disc pocket 72 is moved rearward and rotated. The launch arm 116 is pivotally connected to the housing 12 thought an internal framework 118 such that when the handle 16 is pulled rearward, the launch arm 116 moves from a first or forward position, illustrated to the left in solid lines in FIG. 8, and against the bias of a torsion spring 120, to a second or rearward position, illustrated to the right in phantom lines. After the handle has been pulled back and then pushed forward the rifle is ready to discharge a disc. The operator may then pull on the trigger 22 to release the torsion spring 120 and cause the launch arm 116 to impact the disc 110 in the discharge chamber 90. The back and forth movement of the launch arm 116 is symbolized by a double-headed curved arrow 122.

It is noted that throughout this disclosure, words such as "forward," "rearward," "upward," and "downward," as well as like terms, refer to portions of the toy launch apparatus as they are viewed in the drawings relative to other portions or in relationship to the positions of the apparatus as it will typically be held and moved during play when operated by a user.

In operation, the drum 24 is loaded with discs and mounted to the housing 12. The operator may hold the rifle 10 with one hand on the grip 20 and the other hand around the handle 16. The handle 16 may be pulled rearward to move the disc pocket 72 to the rear and cause it to rotate the disc pocket 90°. The rearward movement of the handle 16 also causes the transfer arm 70 to pivot upward and remove the disc 100 from the drum 24, the transfer arm 70 sliding the removed disc into the disc pocket 72. The rearward motion of the handle 16 also cocks the launch arm 116 against the biased spring 120. The handle 16 is then pushed forward by the operator to reverse rotation of the disc pocket 72, and to move the disc forward into the discharge chamber 90 such that the disc is placed in the path of the launch arm 116 when the launch arm is activated. The forward motion of the handle also cocks the transfer arm. The operator may then pull the trigger 22 rearward causing the launch arm 116 to snap forward with great force against the disc 110 and cause the disc to be discharged.

The present invention also includes a method 200 for making a launch apparatus for toy discs, the steps of the method include providing a housing 202, mounting a container of discs to the housing 204, attaching a slidable handle to the housing 206, the handle being movable between forward and rearward positions to cock the apparatus and move a disc from the container to a discharge chamber in the housing, mounting a pivotal transfer arm in the housing for movement by the handle 208, the transfer arm for removing a disc from the container, mounting a disc pocket in the housing for movement by the handle 210, the disc pocket being movable rearward and forward and rotatable about 90°, and the disc pocket for receiving a disc removed by the transfer arm from the container and locating the disc in the discharge chamber, mounting a pivotal launch arm in the housing for impacting the disc in the discharge chamber 212, connecting a trigger to the housing for releasing the launch arm to cause discharge of the disc 214, and mounting a curved disc retainer in the housing for helping to maintain discs in the disc pocket during rotation 216.

The toy rifle disclosed in detail above has great play value, is fun to use and easy to operate in a safe manner, even for young children, and yet the rifle has a robust, but relatively simple structure, that may be produced at a reasonable cost.

From the foregoing, it can be seen that there has been provided features for an improved launch apparatus for toy discs and a disclosure for the method of the making the launch apparatus. While a particular embodiment of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A launch apparatus for toy discs comprising:

a housing having a longitudinal axis;

a container mounted to the housing for storing toy discs, the discs being stored with rotational axes disposed parallel to the longitudinal axis of the housing;

a handle mounted to the housing movable between first and second positions;

a disc pocket mounted in the housing and operatively connected to the handle for moving the disc pocket between forward and rearward positions, the disc pocket also being rotatable between a disc receiving position and a disc delivery position, the disc pocket rotating to the disc receiving position when the handle moves from the first position to the second position and the disc pocket rotating to the disc delivery position when the handle moves from the second position to the first position;

a spring biased transfer arm pivotally mounted in the housing and operatively connected to the handle for moving a disc from the disc container into the disc pocket when the disc pocket is in the disc receiving position;

a spring biased launch arm pivotally mounted in the housing and operatively connected to the handle, the launch arm being cocked when the handle is moved from the first position to the second position; and a trigger mounted to the housing and operatively connected to the launch arm for activating the launch arm after the disc pocket delivers a disc to a discharge chamber in the housing.

2. The launch apparatus of claim 1 including:

a curved disc retainer mounted in the housing and positioned adjacent the disc pocket as the disc pocket rotates from the disc receiving position.

3. The launch apparatus of claim 1, wherein:

the disc pocket includes a latch for retaining a received disc.

4. The launch apparatus of claim 1, wherein:

the disc pocket is rotatably mounted to a slide frame that moves in a direction parallel to the longitudinal axis of the housing; and the disc pocket is aligned parallel to the slide when in the disc delivery position and perpendicular to the slide when in the disc receiving position.

5. The launch apparatus of claim 1, wherein:

the disc pocket includes first and second spaced apart walls and an opening for receiving a disc between the first and second walls.

6. The launch apparatus of claim 1, wherein:

the transfer arm includes a narrow flat surface for engaging a disc in the container; and the container includes first and second spaced apart front arms and an opening between the first and second arms for receiving the transfer arm.

7. The launch apparatus of claim 1, including:

a blocking pin operatively connected to the handle for abutting the transfer arm when the handle moves from the first position toward the second position.

8. The launch apparatus of claim 1, including:

a curved disc retainer mounted in the housing and positioned adjacent the disc pocket as the disc pocket rotates from the disc receiving position to the disc delivery position; and wherein:

the disc pocket includes a latch for retaining a received disc.

9. The launch apparatus of claim 8, wherein:

the disc pocket is rotatably mounted to a slide frame that moves in a direction parallel to the longitudinal axis of the housing; and the disc pocket is aligned parallel to the slide frame when in the disc delivery position and perpendicular to the slide frame when in the disc receiving position.

10. The launch apparatus of claim 9, wherein:

the disc pocket includes first and second spaced apart walls and an opening for receiving a disc between the first and second walls.

11. The launch apparatus of claim 10, wherein:

the transfer arm includes a narrow flat surface for engaging a disc in the container; and the container includes first and second spaced apart front arms and an opening between the first and second arms for receiving the transfer arm.

12. The launch apparatus of claim 11, including:

a blocking pin operatively connected to the handle for abutting the transfer arm when the handle moves from the first position toward the second position.

13. A launch apparatus for toy discs comprising:

a housing having a discharge chamber and a longitudinal axis;

a container mounted to the housing for storing toy discs, the toy discs being stored with their rotational axes disposed parallel to the longitudinal axis of the housing;

a cocking handle mounted to the housing slidable between forward and rearward positions;

a disc pocket connected to the housing and operatively connected to the handle for moving the disc pocket between forward and rearward positions, the disc pocket also being rotatable between a disc receiving position and a disc delivery position;

a spring biased transfer arm pivotally connected to the housing and operatively connected to the handle for removing a disc from the disc container and inserting the removed disc into the disc pocket when the disc pocket is in the disc receiving position;

a curved disc retainer connected to the housing and positioned adjacent the disc pocket as the disc pocket rotates from the disc receiving position to the disc delivery position;

a spring biased launch arm pivotally connected to the housing and operatively connected to the handle, the launch arm being cocked when the handle is moved from its forward position to its rearward position; and a trigger mounted to the housing and operatively connected to the launch arm for activating the launch arm.

14. The launch apparatus of claim 13, wherein:

the disc pocket includes a latch for retaining a received disc.

15. The launch apparatus of claim 14, wherein:

the disc pocket is rotatably mounted to a slide frame that moves in the housing in a direction parallel to the housing longitudinal axis; and the disc pocket is aligned parallel to the slide frame when in the disc delivery position and perpendicular to the slide frame when in the disc receiving position.

16. The launch apparatus of claim 15, wherein:

the disc pocket includes first and second spaced apart walls and an opening for receiving a disc between the first and second walls.

17. The launch apparatus of claim 16 including:

a blocking pin operatively connected to the handle for abutting the transfer arm when the handle moves from the forward position toward the rearward position.

18. A method for making a launch apparatus for toy discs, the steps of the method comprising:

providing a housing;

mounting a container of discs to the housing;

attaching a slidable handle to the housing, the handle being movable between first and second positions;

connecting a disc pocket in the housing for movement by the handle, the disc pocket being movable between forward and rearward positions and rotatable through 90° for receiving a disc and delivering the disc to a discharge chamber in the housing;

mounting a pivotal transfer arm in the housing for movement by the handle, the transfer arm for removing a disc from the container and inserting the removed disc into the disc pocket;

mounting a pivotal launch arm in the housing for impacting the disc in the discharge chamber; and connecting a trigger to the housing for activating the launch arm.

19. The method of claim 18 including the step of:

mounting a curved disc retainer in the housing for maintaining the received disc in the disc pocket during rotation.

20. The method of claim 19 including the step of:

mounting a latch to the disc pocket.

* * * * *